US006810604B2

(12) United States Patent
Chen et al.

(10) Patent No.: US 6,810,604 B2
(45) Date of Patent: Nov. 2, 2004

(54) SHOE HAVING A HOLLOW INSOLE COMPONENT

(75) Inventors: Eddie Chen, 9F, No. 201, Sec. 1, Taichung-Kang Rd., Taichung City (TW); Melissa Wang, Taichung (TW)

(73) Assignee: Eddie Chen, Taichung (TW)

( * ) Notice: Subject to any disclaimer, the term of this patent is extended or adjusted under 35 U.S.C. 154(b) by 160 days.

(21) Appl. No.: 10/303,136

(22) Filed: Nov. 21, 2002

(65) Prior Publication Data

US 2004/0098880 A1 May 27, 2004

(51) Int. Cl.[7] ..... A43B 9/10; A43B 9/02

(52) U.S. Cl. ..... 36/14; 36/55; 36/16; 36/17 R; 36/18

(58) Field of Search ..... 36/14, 16, 55, 36/17 R, 18

(56) References Cited

U.S. PATENT DOCUMENTS

| | | | | | |
|---|---|---|---|---|---|
| 2,039,287 | A | | 5/1936 | Arnold | |
| 2,201,383 | A | | 5/1940 | Vizard | |
| 3,076,274 | A | | 2/1963 | Schlecht | 36/54 |
| 3,736,613 | A | * | 6/1973 | Tusa et al. | 12/142 D |
| D341,481 | S | | 11/1993 | Peterson | D2/320 |
| 5,384,971 | A | | 1/1995 | Ferry | 36/105 |
| RE34,890 | E | * | 4/1995 | Sacre | 36/55 |
| 5,469,640 | A | | 11/1995 | Nichols | 36/50.1 |
| D383,893 | S | | 9/1997 | Leick | D2/897 |
| D385,987 | S | | 11/1997 | Bramani | D2/959 |
| 5,802,740 | A | | 9/1998 | Merk, Sr. | 36/55 |
| D402,095 | S | | 12/1998 | Cretinon | D2/957 |
| 5,943,791 | A | * | 8/1999 | Pavelescu et al. | 36/14 |
| D414,023 | S | | 9/1999 | Cretinon et al. | D2/957 |
| D414,594 | S | | 10/1999 | Parisotto | D2/959 |
| 5,964,047 | A | | 10/1999 | Covatch | 36/55 |
| D416,669 | S | | 11/1999 | Parr et al. | D2/954 |
| 5,992,054 | A | * | 11/1999 | Rauch | 36/30 R |
| D420,497 | S | | 2/2000 | Panella | D2/957 |
| 6,065,227 | A | | 5/2000 | Chen | 36/4 |
| D433,791 | S | | 11/2000 | Laberge | D2/957 |
| D434,550 | S | | 12/2000 | LaBerge | D2/957 |
| 6,192,605 | B1 | * | 2/2001 | Challant | 36/17 R |
| D439,031 | S | | 3/2001 | Matis et al. | D2/959 |
| D440,749 | S | | 4/2001 | Rogers | D2/959 |
| D442,768 | S | | 5/2001 | Matis | D2/957 |
| 6,305,101 | B2 | | 10/2001 | Chemello | 36/10 |
| D450,428 | S | | 11/2001 | Cretinon et al. | D2/953 |
| 6,367,166 | B1 | | 4/2002 | Barthelemy et al. | 36/3 |
| D456,982 | S | | 5/2002 | Rogers | D2/957 |
| 6,408,541 | B1 | * | 6/2002 | Moretti | 36/12 |
| D460,608 | S | | 7/2002 | Laberge et al. | D2/957 |
| 6,412,193 | B1 | | 7/2002 | Chen | |
| D462,157 | S | | 9/2002 | Burt | D2/953 |
| 6,474,002 | B2 | * | 11/2002 | Chen | 36/55 |
| D467,712 | S | | 12/2002 | Delgorgue et al. | D2/957 |
| D468,083 | S | | 1/2003 | Morais | D2/960 |
| 2003/0093919 | A1 | | 5/2003 | Wang | 36/10 |
| 2003/0200679 | A1 | | 10/2003 | Wilson et al. | 36/55 |

OTHER PUBLICATIONS

U.S. patent application Ser. No. 10/241,919, Chen, filed Sep. 12, 2002.

U.S. patent application Ser. No. 29/167,920, Chen et al., filed Sep. 23, 2002.

U.S. patent application Ser. No. 10/267,429, Chen et al., filed Oct. 8, 2002.

U.S. patent application Ser. No. 10/285,248, Chen et al., filed Oct. 30, 2002.

* cited by examiner

*Primary Examiner*—Jila M. Mohandesi
(74) *Attorney, Agent, or Firm*—Ladas & Parry LLP

(57) ABSTRACT

A shoe includes a hollow insole component which has a horizontal part with an inner peripheral end confining an opening and an upward flange extending upward from a top face of the horizontal part, an upper having a bottom open end attached to the horizontal part; and a lining mounted within the upper and having a bottom open end attached to the upward flange, wherein the hollow insole component is made by forming an elongated strip into a loop, and the insole component has a connection joint extending transversely of the hollow insole component.

13 Claims, 9 Drawing Sheets

SHOE HAVING A HOLLOW INSOLE COMPONENT

BACKGROUND OF THE INVENTION

1. Field of the Invention

This invention relates to a shoe, more particularly to a shoe having a hollow insole component.

2. Description of the Related Art

It is known to provide a shoe with waterproof breathable characteristics by disposing a sock-like waterproof breathable lining inside a non-waterproof breathable shoe. Such a waterproof breathable lining typically has a closed bottom to cover a wearer's foot and is liable to break at its closed bottom due to stress induced by the wearer's foot.

The prior art also suggests a waterproof breathable lining having a bottom open end to be secured to an insole of a shoe by adhesive bonding. Various methods are available in the art for securing the bottom open end of the lining to the insole so as to provide sufficient waterproof characteristics between the insole and the lining. However, these methods are generally laborious and time consuming.

To address the problem encountered with the securing of the bottom open end of a lining, U.S. Pat. No. 6,412,193 B1 suggests a shoe having a waterproof breathable lining 2 having a bottom open end positioned to an upward flange of a hollow sole pad 3 secured to the bottom of an upper 1 of the shoe, as shown in FIG. 1. Since the bottom open end of the lining is positioned above the top face of the sole pad 3, the assembling of the lining 2 is simplified, and the problem of breaking the lining 2 due to the stress induced by the wearer's foot can be alleviated. However, since the sole pad 3 disclosed therein is a one-piece hollow member which is injection molded, a lot of differently sized molds are required to produce varying sizes of the sole pads, thereby increasing the manufacturing costs. It is desirable to manufacture various sizes of the hollow sole pads without the need to use a large number of molds. An approach is to form the hollow sole pad by looping an elongated strip.

Welted shoe systems utilizing strips are known in the art. These strips are typically stitched to an insole, an outsole and an upper. Examples of the welted shoe systems are disclosed in U.S. Pat. Nos. 2,201,383 and 2,039,287. In these welted shoes, while upward flanges are formed in strips, the flanges are not suggested to support a bottom end of a lining and to keep the lining bottom end above the top surface of an insole, and the strips are not contemplated to be used as an insole component.

SUMMARY OF THE INVENTION

An object of the invention is to provide a shoe which has a hollow insole component formed by looping an elongated strip and which permits varying of the size of the insole component by changing the length of the strip.

Another object of the invention is to provide shoes which can be produced using a simplified method that can provide different sizes of hollow insole components without the need to use a large number of differently sized molds.

Accordingly, a shoe according to the present invention comprises: a hollow insole component including a horizontal part with an inner peripheral end confining an opening and an upward flange extending upward from a top face of the horizontal part; an upper disposed above the insole component and having a bottom open end extending around the upward flange and attached to the horizontal part; and a lining mounted within the upper and having a bottom open end attached to the upward flange, wherein the hollow insole component is made by forming an elongated strip into a loop, and the insole component has a connection joint extending transversely of the insole component.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
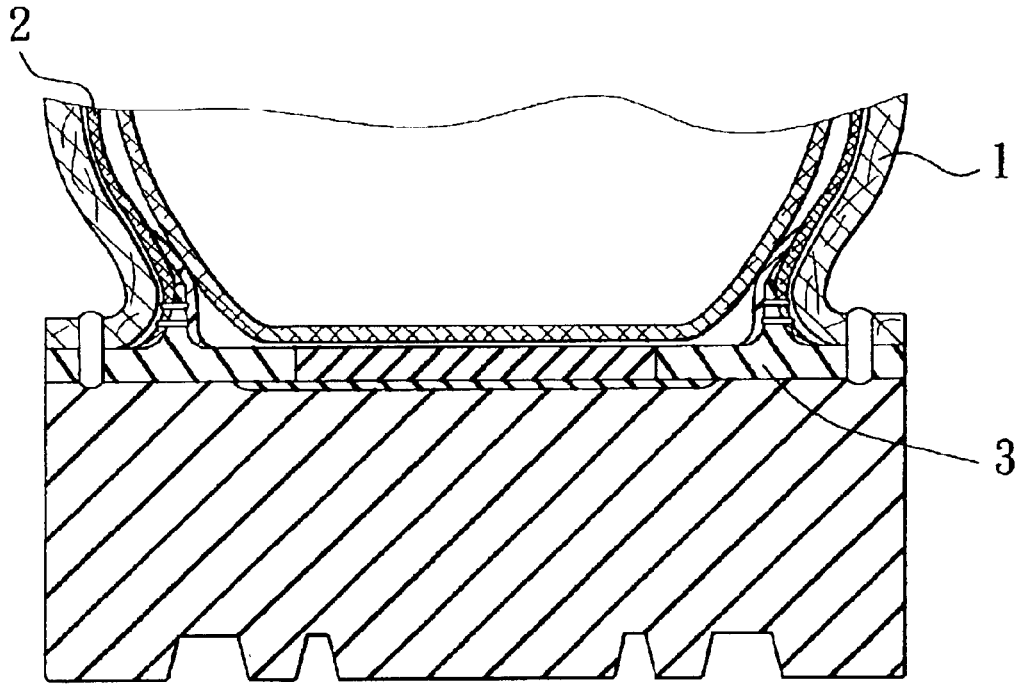
FIG. 1 PRIOR ART
FIG. 1 is a view of the prior art.
Figure 2:
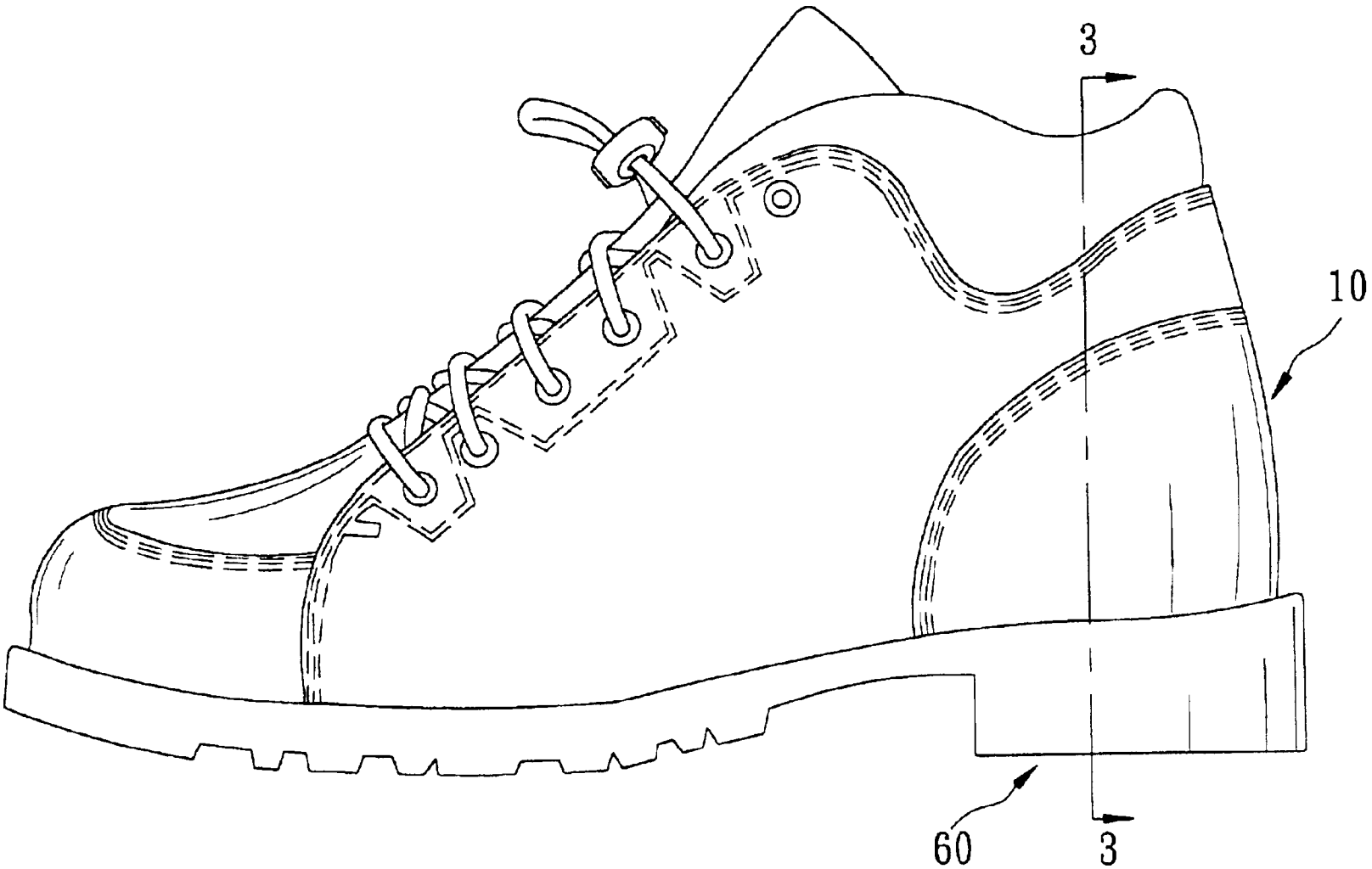
FIG. 2 is an elevation view of a first embodiment of the present invention.
Figure 3:
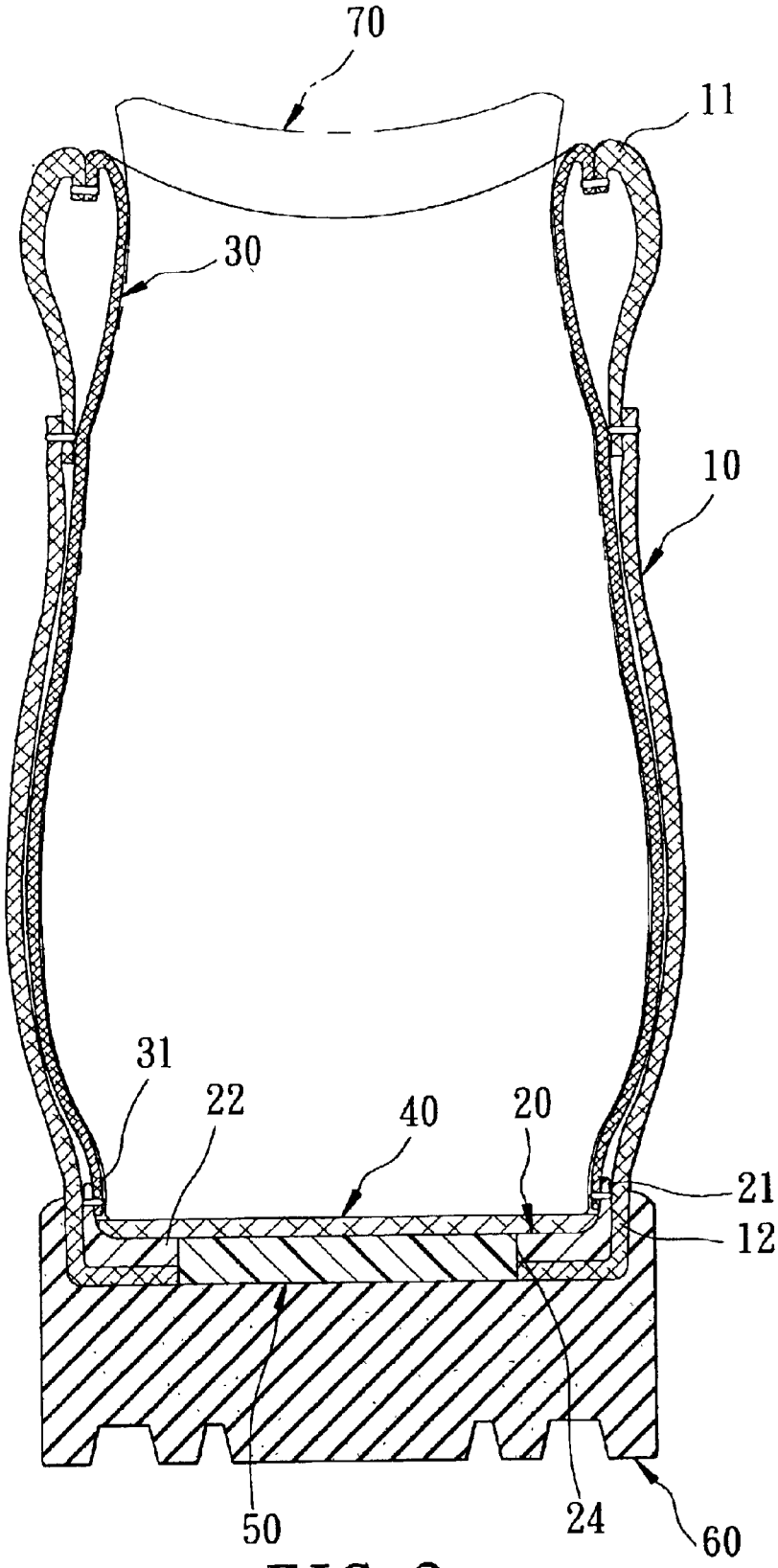
FIG. 3 is a sectional view taken along line 3—3 of FIG. 1.
Figure 4A:
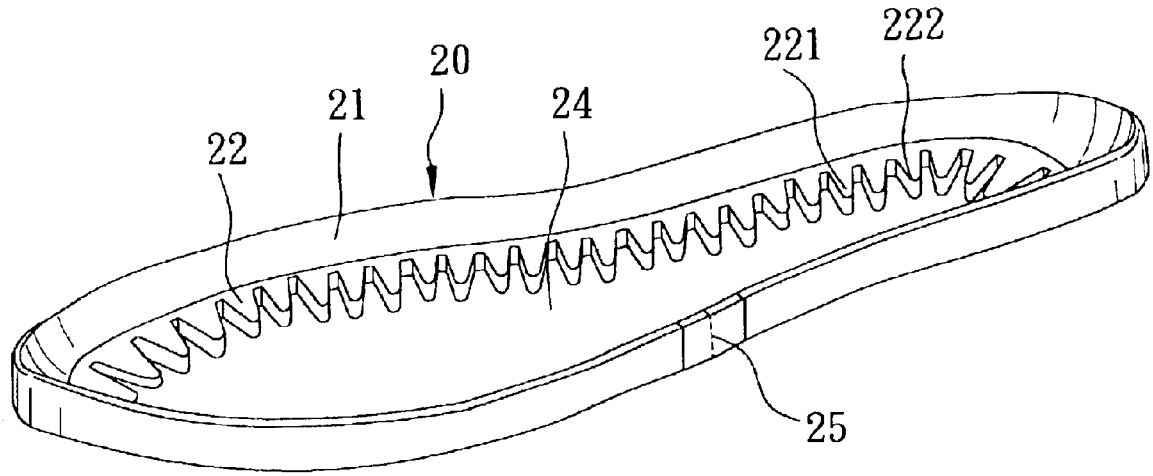
FIG. 4A is a perspective view of the hollow insole component of FIG. 3.
Figure 4B:
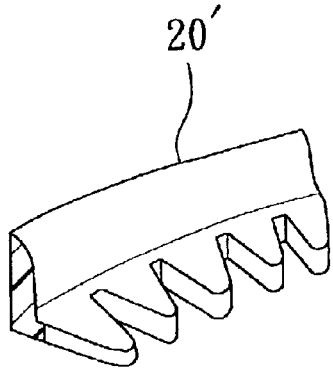
FIG. 4B is a fragmentary perspective view of an elongated strip shown in FIG. 3.

Referring to FIGS. 2, 3, 4A and 4B, a first preferred embodiment of the present invention is shown to include an upper 10, a hollow insole component 20, a lining 30, an insole pad 40, a filler 50, and an outsole 60.

The upper 10 has a top open end 11 and a bottom open end 12. The lining 30 generally has a sock-like shape but is provided with a bottom open end 31. Preferably, the lining 30 is made of a waterproof breathable material which may be one sold under the trade name of Goretex or Sympatex.

The hollow insole component 20 has a substantially L-shaped cross-section and includes a horizontal part 22 and an upward flange 21 extending upward from the horizontal part 22. The horizontal part 22 has an inner peripheral end 221 which confines an opening 24. The hollow insole component 20 is formed by looping a longitudinal strip 20' to join two ends of the longitudinal strip 20'. Thus, a connection joint 25 which extends transversely of the hollow insole component 20 is formed in the hollow insole component 20. Preferably, the inner peripheral end 221 is provided with a toothed edge 222 so as to facilitate the bending of the strip 20' to prevent the inner peripheral end 221 from being wrinkled after the strip 20' is looped. The longitudinal strip 20' may be fabricated by extrusion or injection molding a plastic material or a rubber, or by forming a leather. On the other hand, the longitudinal strip 20' maybe a strip section which is cut from a long and continuous strip.

The lining 30 is disposed inside the upper 10 and has a top end connected to the top open end 11 of the upper 10. The bottom open end 31 of the lining 30 extends above the top face of the horizontal part 22 of the insole component 20.

The hollow insole component 20 has a length which is not shorter than a peripheral length of a last 70 that is used to last the upper 10. In assembly, the bottom open end 31 of the lining 30 extends inwardly of the upward flange 21 of the insole component 20 and is attached thereto by stitching.

The insole pad 40 is positioned within the upward flange 21 above the horizontal part 22 with an outer periphery of the insole pad 40 abutting against the inner surface of the upward flange 21, and the toothed edge 222 of the inner peripheral end 221 is adhered to the insole pad 40. The shape of the hollow insole component 20 is therefore set by the insole pad 40. The upper 10 is lasted by using the last 70 and by folding the bottom open end 12 of the upper 10 over the bottom side of the horizontal part 22. The opening 24 is filled with the filler 50. The outsole 60 is attached to the bottom open end 12 of the upper 10 and to the filler 50.

Figure 5:
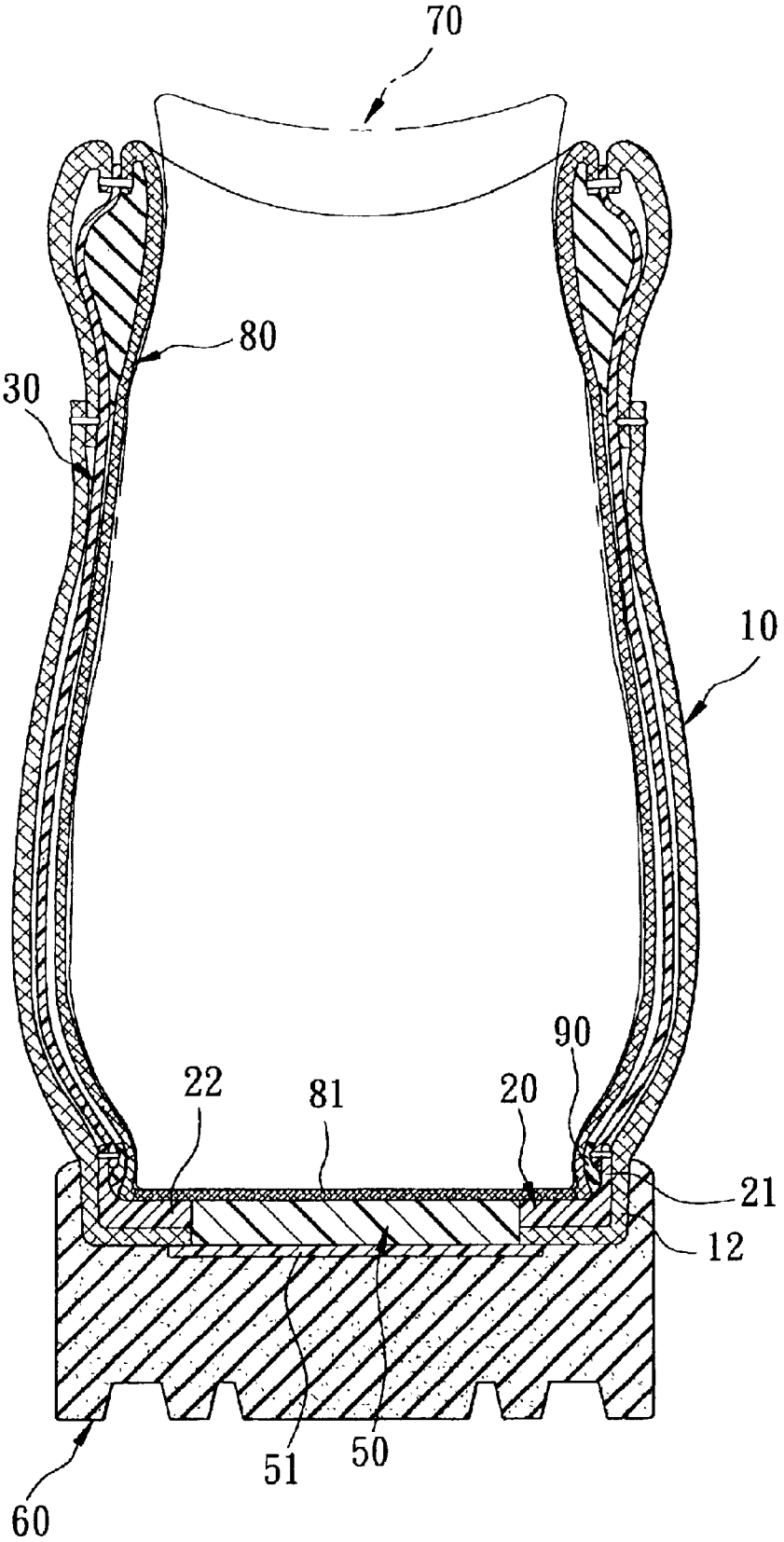
FIG. 5 is a sectional view of a second embodiment of the present invention.

Referring to FIG. 5, a second embodiment of the present invention is shown to have a construction substantially similar to that of the first embodiment except that the second embodiment additionally includes an inner liner 80, a waterproof sealing member 90, and a waterproof cover 51. The inner liner 80 is disposed inside the lining 30 and has a closed bottom which forms a sole part 81. This sole part 81 has a measure of stiffness and acts like the insole pad 40 of the first embodiment to set the shape of the hollow insole component 20. The waterproof sealing member 90 is attached to the bottom open end 31 of the lining 30 and the upward flange 21 of the hollow insole component 20 to seal the juncture between the lining 30 and the upward flange 21. The waterproof cover 51 is attached to the bottom open end 12 of the upper 10 and the filler 50.

Figure 6A:
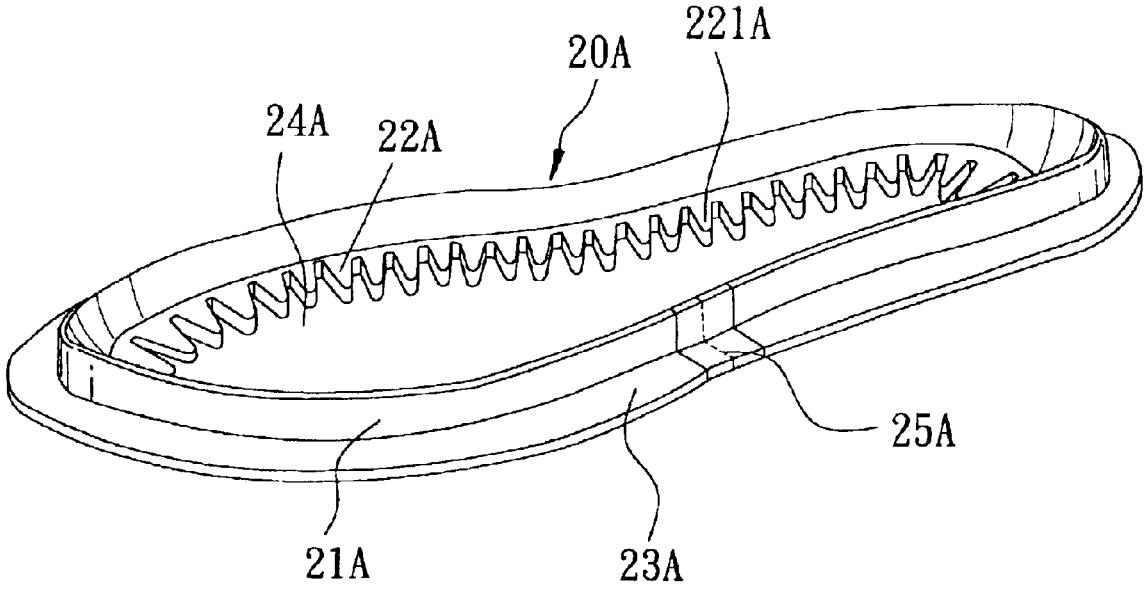
FIG. 6A is a perspective view of the hollow insole component of a third embodiment of the present invention.
Figure 6B:
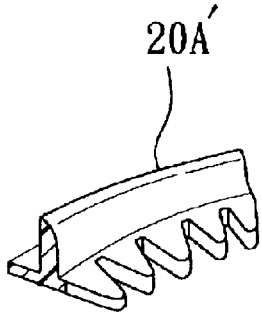
FIG. 6B is a perspective view of a strip used in the third embodiment.
Figure 7:
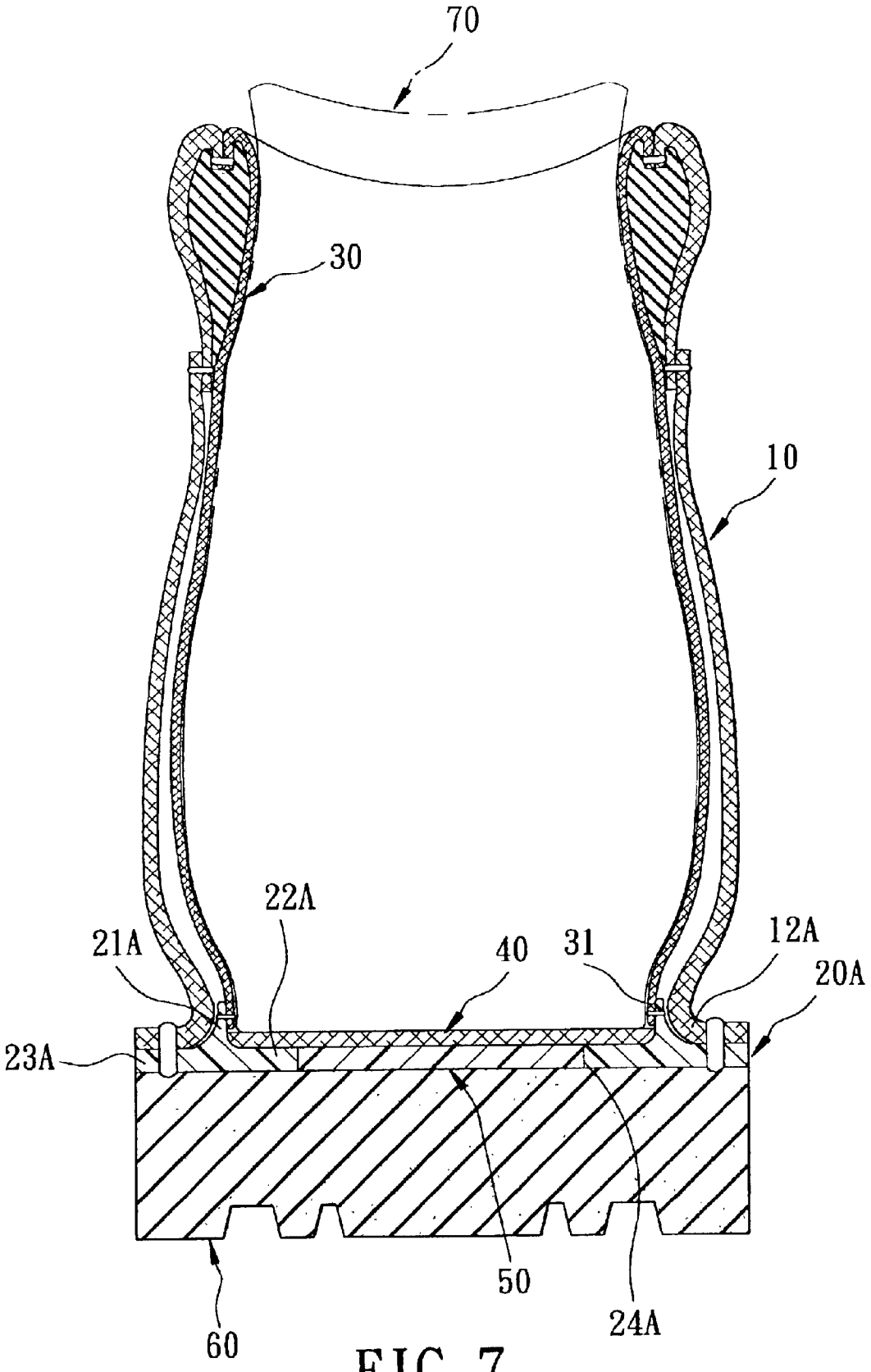
FIG. 7 is a sectional view of the third embodiment.

Referring to FIGS. 6A, 6B, 7, a third embodiment of the present invention is shown, wherein elements similar to those of the first embodiment are represented by like reference numerals. In this embodiment, the stitchdown shoe includes an upper 10 with a bottom open end 12A turned outward and stitched to a hollow insole component 20A. The insole component 20A has a connection joint 25A and is formed by looping a strip 20A' having a T-shaped cross-section. Due to the T-shaped cross-section of the strip 20A', the hollow insole component 20A is formed with a horizontal part 22A which has an inner peripheral end 221A confining an opening 24A, an outer peripheral end 23A around the inner peripheral end 221A, and an upward flange 21A extending upward from the horizontal part 22A between the inner and outer peripheral ends 221A and 23A. The size of the hollow insole component 20A depends upon the length of the strip 20A'. The length of the strip 20A' is determined by a last 70 used to last the upper 10. The strip 20A' is cut from a long continuous strip with a length not shorter than the periphery of the last 70.

In assembly, the bottom open end 12A of the upper 10 is stitched to the outer peripheral end 23A of the insole component 20A. The bottom open end 31 of the lining 30 is stitched to the upward flange 21A, thereby positioning the bottom open end 31 above a top surface of the insole component 20A.

An insole pad 40 is placed on the hollow insole component 20A within the space confined by the upward flange 21A. The outer periphery of the insole pad 40 abuts against the inner surface of the hollow insole component 20A, thus setting the shape of the hollow insole component 20A. The hollow insole component 20A is made of a high strength material, whereas the insole pad 40 is made of a light weight, less strength material to reduce the total weight of the assembly of the hollow insole component 20A and the insole pad 40.

Figure 8:
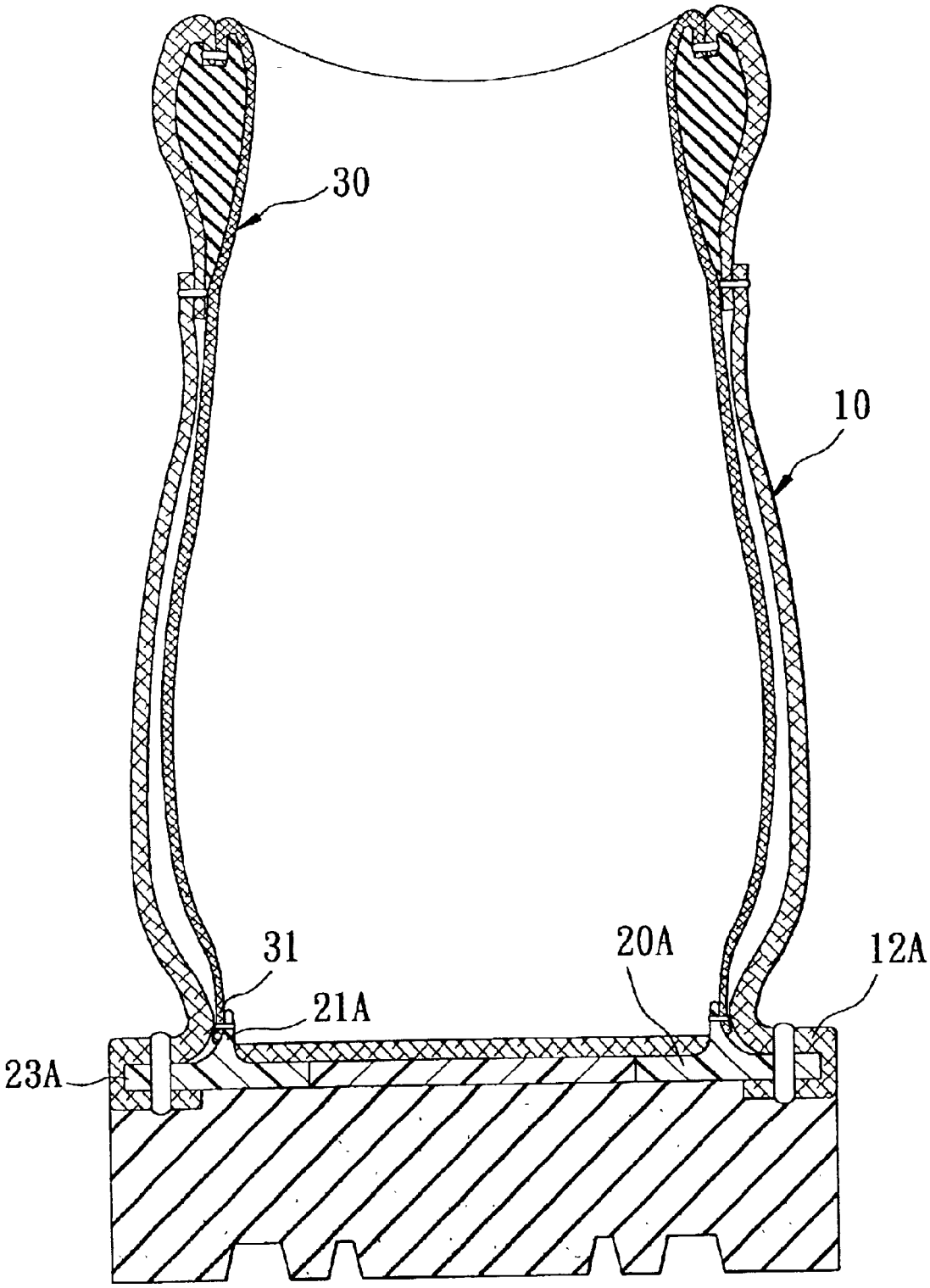
FIG. 8 is a sectional view of the fourth embodiment.

Referring to FIG. 8, in a fourth embodiment of the present invention, the bottom open end 31 of the lining 30 extends outwardly of the upward flange 21A of the hollow insole component 20A and abuts an outer surface of the upward flange 21A. The bottom open end 12A of the upper 10 is turned outward and is then folded inward to extend below the outer peripheral end 23A of the hollow insole component 20A.

Figure 9:
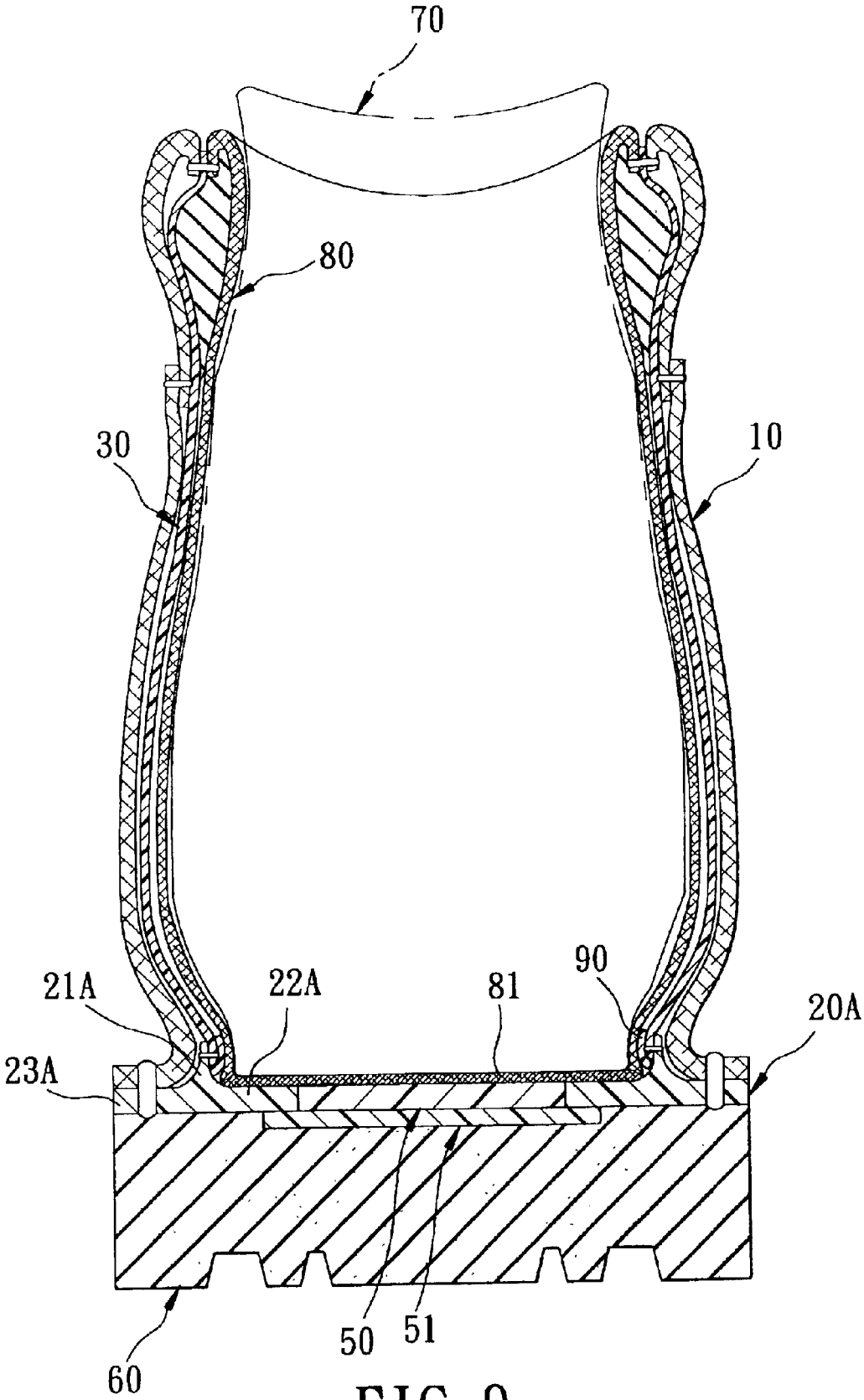
FIG. 9 is a sectional view of the fifth embodiment.

FIG. 9 show a fifth embodiment of a shoe according to the present invention which differs from the third embodiment as described hereinafter. This embodiment additionally includes an inner liner 80 disposed within the lining 30 with a sole part 81 of the liner 80 being positioned within the upward flange 21A of the insole component 20A, a waterproof sealing member 90 attached to the lining 30 and the upward flange 21A, and a waterproof plate 51 attached to the bottom sides of the insole component 20A and a filler 50.

Since the hollow insole components 20 and 20A are made from the elongated strips 20' and 20A' which can be easily produced as mentioned above, the hollow insole components 20, 20A can be provided with different sizes by simply changing the length of the strips 20' 20A', thereby eliminating without the need to use a large number of molds.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A shoe comprising:

a hollow insole component including a horizontal part with an inner peripheral end confining an opening and an upward flange extending upward from a top face of said horizontal part;

an upper disposed above said insole component and having a bottom open end extending around said upward flange and attached to said horizontal part; and a lining mounted within said upper and having a bottom open end attached to said upward flange;

wherein said hollow insole component is made by forming an elongated strip into a loop, and said insole component has a connection joint extending transversely of said insole component.

2. The shoe as claimed in claim 1, wherein said hollow insole component has an L-shaped cross-section, said bottom open end of said upper being turned inward and folded over a bottom face of said horizontal part.

3. The shoe as claimed in claim 1, wherein said hollow insole component has a T-shaped cross-section and further includes an outer peripheral end extending around said inner peripheral end, said upward flange extending upward between said inner and outer peripheral ends.

4. The shoe as claimed in claim 3, wherein said bottom open end of said upper is turned outward above said horizontal part and stitched to said horizontal part.

5. The shoe as claimed in claim 1, wherein said bottom open end of said lining is stitched to said upward flange.

6. The shoe as claimed in claim 1, further comprising an insole pad positioned on said hollow insole component within said upward flange and having an outer periphery abutting an inner surface of said upward flange to set the shape of the hollow insole component.

7. The shoe as claimed in claim 6, wherein said inner peripheral end of said insole component is adhered to said insole pad.

8. The shoe as claimed in claim 7, wherein said inner peripheral end of said insole component has a toothed edge.

9. The shoe as claimed in claim 1, wherein said inner peripheral end of said insole component has a toothed edge.

10. The shoe as claimed in claim 1, wherein said lining is made of a waterproof breathable material.

11. The shoe as claimed in claim 1, further comprising an inner liner disposed within said lining.

12. The shoe as claimed in claim 11, wherein said inner liner has a sole part positioned within said upward flange.

13. The shoe as claimed in claim 1, further comprising a waterproof sealing member attached to said bottom open end of said lining and said upward flange to seal a juncture formed between said lining and said upward flange.

* * * * *